US005287576A

United States Patent [19]

Fraser

[11] Patent Number: 5,287,576

[45] Date of Patent: Feb. 22, 1994

[54] HEAD SUPPORT

[76] Inventor: Lance G. Fraser, 1509 Windermere Ct., Palmdale, Calif. 93551

[21] Appl. No.: 14,861

[22] Filed: Feb. 8, 1993

[51] Int. Cl.[5] ..... A47G 9/00; A61G 13/12

[52] U.S. Cl. ..... 5/637; 5/636; 5/638; 5/640; 5/641; 5/644; 5/911

[58] Field of Search ..... 5/636, 637, 638, 640, 5/641, 643, 644, 622; 128/202.18; D6/601

[56] References Cited

U.S. PATENT DOCUMENTS

| | | | |
|---|---|---|---|
| 3,337,883 | 8/1967 | Allison | 5/638 |
| 4,504,050 | 3/1985 | Osborne | 5/640 |
| 4,752,064 | 6/1988 | Voss | 5/638 |
| 5,038,431 | 8/1991 | Burgin et al. | 5/641 |

*Primary Examiner*—Alexander Grosz
*Attorney, Agent, or Firm*—S. Michael Bender

[57] ABSTRACT

A new and improved head support apparatus includes a base member and a nonrigid chin rest member, a nonrigid forehead rest member, and a number of peripheral guide members supported by the base member. The chin rest member and the forehead rest member project from the base member a first vertical distance which is longer than a nose of the person when the chin of the person is resting on the chin rest member and the forehead of the person is resting on the forehead rest member. The forehead rest member is spaced from the chin rest member by a horizontal distance which is greater than a height of the nose of the person. The peripheral guide members project from the base member a vertical distance which is longer than the first vertical distance, and the peripheral guide members are spaced from one another on the base member by a horizontal distance which is sufficient to permit the person's head to be restrained between the peripheral guide members when the forehead of the person is resting on the forehead rest member. The base member includes air channels for supplying air to the chin rest member and the forehead rest member. The chin rest member and the forehead rest member also include glass microspheres. A slidable carriage may be provided to adjust the positions of the peripheral guide members to accommodate different head sizes. In addition, an aroma diffuser assembly may be present in the base member.

12 Claims, 4 Drawing Sheets

HEAD SUPPORT

BACKGROUND OF THE INVENTION

1. Field of the Invention

The present invention relates generally to head supports, and more particularly, to a head support apparatus especially adapted to support a patient's head when the patient is lying in a prone position.

2. Description of the Prior Art

Head supports are well known in the art. For example, the following U.S. Pat. Nos. disclose head supports: 4,345,347 of Kantor; 4,821,736 of Watson; 4,918,774 of Popitz; 4,928,711 of Williams; and Des. 244,336 of Stein. Yet, none of the patents cited disclose a head support apparatus that is suitable for supporting a patient's head when the patient is lying in a prone position, on the patient's stomach, such as during surgery or during a medical examination.

When a patient is in a prone position during surgery, the patient's head is most often turned to either the right or left; and the patient's head rests on its left side or right side, respectively. With the head turned in this way, the windpipe may be somewhat constricted. Also, with the head turned in this way, certain neck muscles may be overly stressed resulting in aching neck muscles for some period of time after surgery or the examination is over. In this respect, it would be desirable if a head support were provided in which the head would not be turned and the windpipe would not be constricted when the patient is lying in a prone position. Also, it would be desirable if a head support were provided in which the head is not turned and excessive stress is not applied to neck muscles when the patient is lying in a prone position.

A conventional pillow may also be used to support a head. When a patient is in a supine position, lying on the patient's back, and the patient's face oriented straight up, there is no problem with the patient being suffocated by the pillow. However, when the patient is in a prone position, if a patient's face would be placed face down on a pillow, then the pillow may suffocate the patient. With a pillow, no clearance or open space is provided to permit the patient to breath through the mouth or nose when the patient is in a prone position, without turning the patient's head to the right or left as described above. Thus, it would be desirable if a head support apparatus were provided which supported a patient's face in a prone position with a provision for permitting the patient to breath through the mouth and/or nose.

The head supports mentioned above all use solid materials to provide the support needed. The solid materials may be of a number of types such as: a particulate material, such as feathers in a pillow; a foam material such as foam rubber; or a canvas material, among others. Pillows containing air are also known. However, such air-containing pillows are not known to be suitable for supporting a patient in a prone position during surgery or medical examination without turning the patient's head to the left or right side.

Thus, while the foregoing body of prior art indicates that it is well known to use head rests generally, the provision of a simple and cost effective device for supporting a patient's head while the patient is in a prone position is not contemplated. Also, the prior art does not provide a head support with which the head is not turned, and the windpipe is not constricted. Nor does prior art provide a head support in which the head is not turned, and excessive stress is not applied to neck muscles when the patient is lying in a prone position. In addition, the prior art does not provide a head support which supports a patient's face in a prone position and also permits the patient to breath through the mouth and/or nose. Also, the prior art does not provide air-cushioning pillows which are suitable for supporting a patient in a prone position during surgery or medical examination. The foregoing disadvantages are overcome by the unique head support apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved head support apparatus which includes a base member and a nonrigid chin rest member, a nonrigid forehead rest member, and a number of peripheral guide members supported by the base member. The chin rest member and the forehead rest member project from the base member a first vertical distance which is longer than a nose of the person when the chin of the person is resting on the chin rest member and the forehead of the person is resting on the forehead rest member. The forehead rest member is spaced from the chin rest member, on the base member, by a horizontal distance which is greater than a height of the nose of the person. The peripheral guide members project from the base member a vertical distance which is longer than the first vertical distance, and peripheral guide members are spaced from one another on the base member by a horizontal distance which is sufficient to permit the person's head to be restrained between the peripheral guide members when the forehead of the person is resting on the forehead rest member.

The base member includes air channels for supplying air to the chin rest member and the forehead rest member. The chin rest member and the forehead rest member also include glass microspheres. A slidable carriage may support the peripheral guide members; and a groove in the base member then supports the slidable carriage. Adjustment screws are provided for locking the slidable carriage in a selected position with respect to groove. In addition, an aroma diffuser assembly supported may be present in the base member.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved head support apparatus which has all of the advantages of the prior art and none of the disadvantages.

It is another object of the present invention to provide a new and improved head support apparatus which may be easily and efficiently manufactured and marketed.

It is a further object of the present invention to provide a new and improved head support apparatus which is of durable and reliable construction.

An even further object of the present invention is to provide a new and improved head support apparatus which is susceptible of a low cost of manufacture with regard to both materials and labor, and which accordingly is then susceptible of low prices of sale to the consuming public, thereby making such head support apparatus available to the buying public.

Still yet a further object of the present invention is to provide a new and improved head support apparatus that is suitable for supporting a patient's head when the patient is lying in a prone position, such as during surgery or during a medical examination.

Still another object of the present invention is to provide a new and improved head support apparatus in which the head is not turned and the windpipe is not constricted as the head is supported.

Yet another object of the present invention is to provide a new and improved head support apparatus with which the head is not turned, and excessive stress is not applied to neck muscles.

Even another object of the present invention is to provide a new and improved head support apparatus which supports a patient's face in a prone position and permits the patient to breath through the mouth and/or nose.

Still a further object of the present invention is to provide a new and improved head support apparatus which cushions with air and which is suitable for supporting a patient in a prone position during surgery or medical examination.

These together with still other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
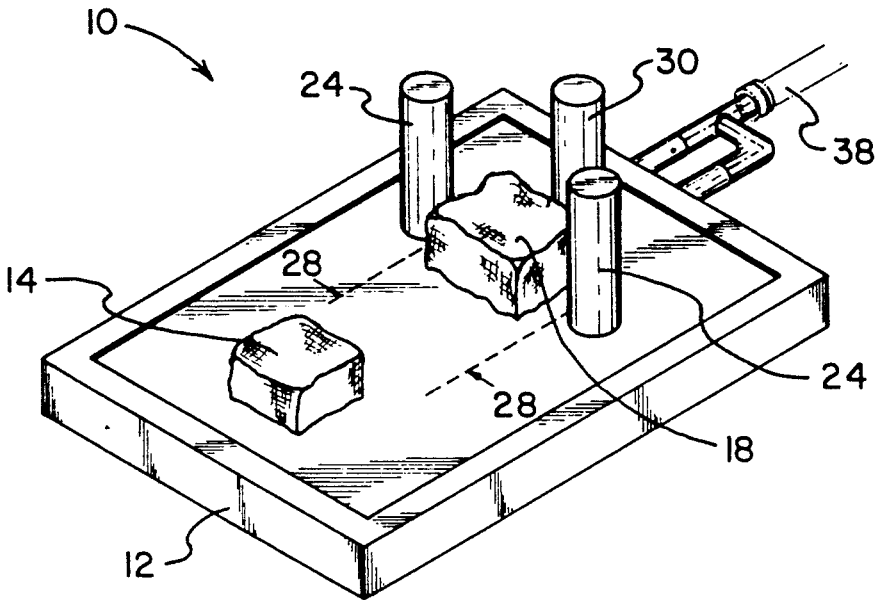
FIG. 1 is a perspective view showing a first preferred embodiment of the head support apparatus of the invention.
Figure 2:
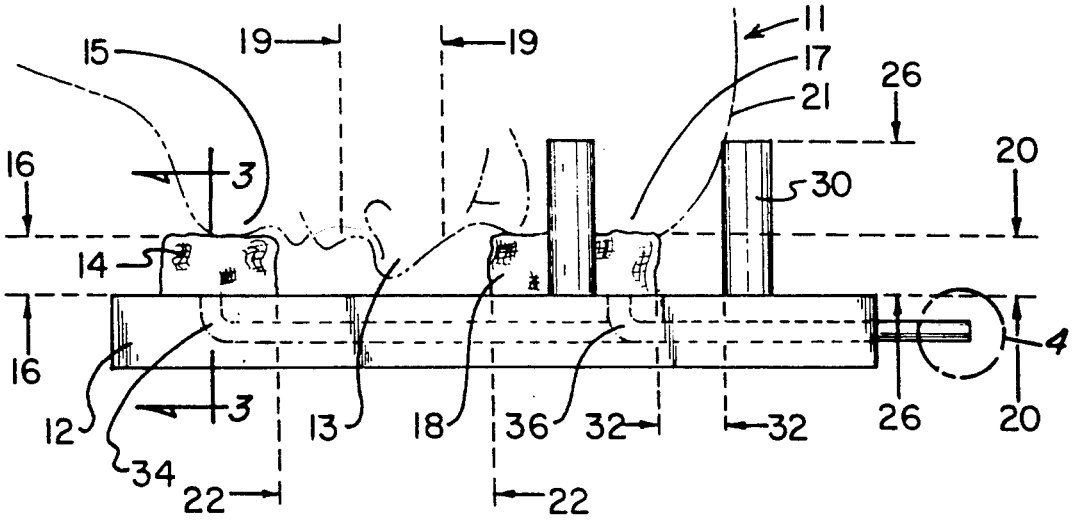
FIG. 2 is an enlarged side view of the head support apparatus of FIG. 1.

With reference to the drawings, a new and improved head support apparatus embodying the principles and concepts of the present invention will be described.

Turning initially to FIGS. 1–4, there is shown a first exemplary embodiment of the head support apparatus of the invention generally designated by reference numeral 10. In its preferred form, head support apparatus 10 is for a person's head 11 and includes a base member 12, a nonrigid chin rest member 14 supported by the base member 12 and projecting from the base member 12 a first vertical distance 16 which is longer than a nose 13 of the person when a chin 15 of the person is resting on the chin rest member 14.

The head support apparatus 10 of the invention also includes a nonrigid forehead rest member 18 supported by the base member 12 and projecting from the base member 12 a second vertical distance 20 which is longer than the nose 13 of the person when a forehead 17 of the person is resting on the forehead rest member 18, and wherein the forehead rest member 18 is spaced from the chin rest member 14, on the base member 12 by a first horizontal distance 22 which is greater than a height 19 of the nose of the person.

Two peripheral guide members 24 are supported by the base member 12 and project from the base member 12 a third vertical distance 26 which is longer than the first and second vertical distances 16 and 20. The two peripheral guide members 24 are spaced from one another on the base member 12 by a second horizontal distance 28 which is sufficient to permit the person's head 11 to be restrained between the peripheral guide members 24 when the forehead 17 of the person is resting on the forehead rest member 18.

A third peripheral guide member 30 is supported by the base member 12 and projects from the base member 12 by the third vertical distance 26 which is longer than the first and second vertical distances 16 and 20. The third peripheral guide member 30 is spaced from the forehead rest member 18 by a third horizontal distance 32 which is sufficient to permit a top 21 of the person's head to be restrained by the third peripheral guide member 30 when the forehead 17 of the person is resting on the forehead rest member 18.

The base member 12 includes a first air channel 34 for supplying air to the chin rest member 14 and a second air channel 36 for supplying air to the forehead rest member 18. The first air channel 34 and the second air channel 36 diverge from a common supply tube 38. The common supply tube 38 includes a one-way valve 40. A conventional air pump (not shown) is used to supply pressurized air to the air channels 34 and 36.

Figure 3:
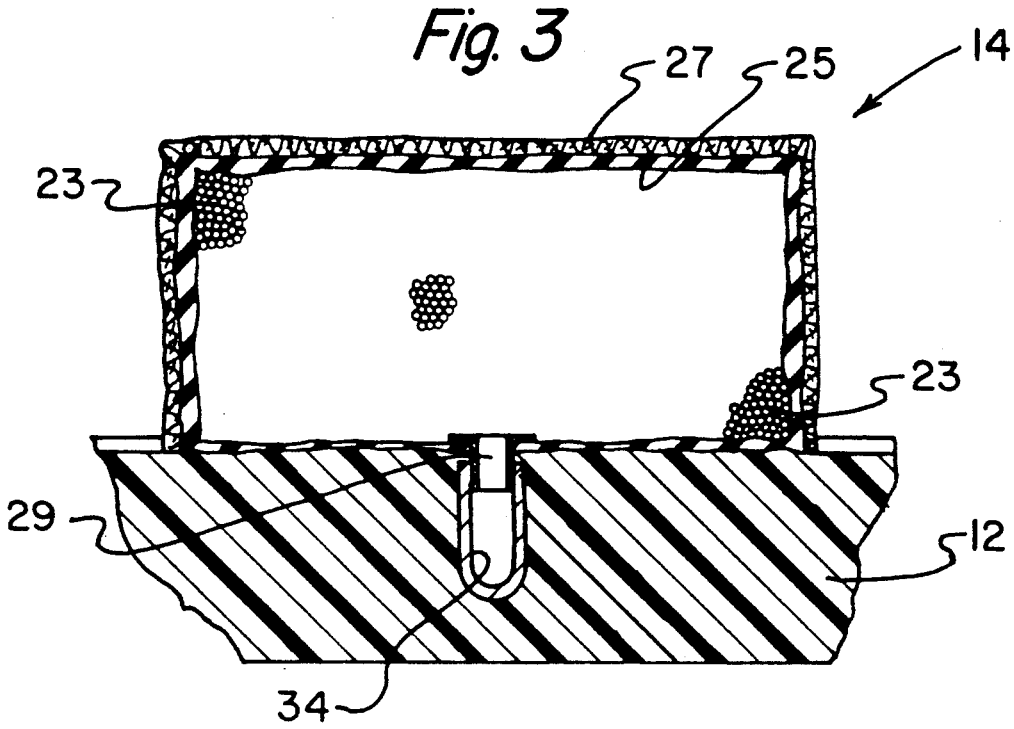
FIG. 3 is a cross-sectional view of the head support apparatus of FIG. 2 taken along line 3—3 thereof.
Figure 4:
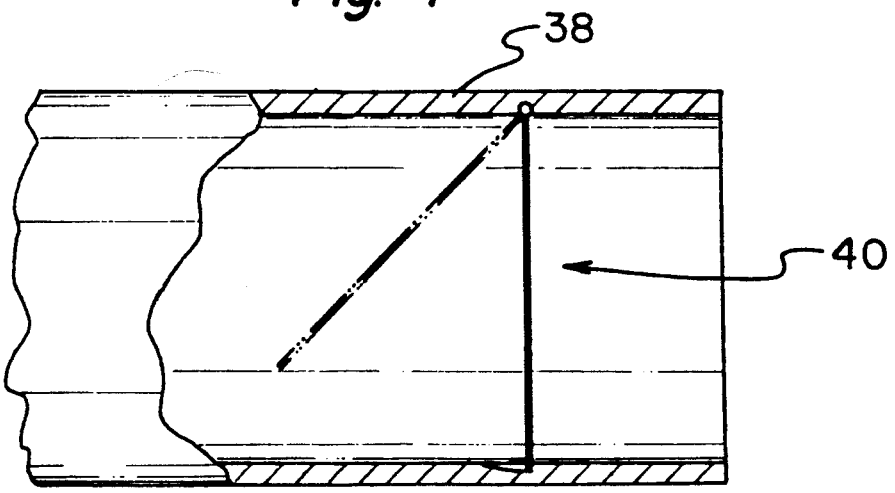
FIG. 4 is an enlarged region of the embodiment of the invention shown in FIG. 2 that is contained in the circled region 4 of FIG. 2.

The chin rest member 14 and the forehead rest member 18 include glass microspheres 23. As shown in FIG. 3, the chin rest member 14 also includes a rubber bladder 25 which is contained within an outer fabric covering 27. A fitting 29 is present to connect the interior space of the chin rest member 14 to the first air channel 34.

In use, when a person's head 11 is positioned on the head support apparatus 10 of the invention, such as during surgery, the person's chin and forehead are gently cushioned by the chin rest member 14 and the forehead rest member 18, respectively. The combination of air pressure and microspheres provides a particularly effective, gentle cushioning action. At the same time, the person's head 11 is retained in a prone position without constricting the windpipe. Moreover, a clearance is provided for the person's nose 13 so that breathing is unimpeded.

Figure 5:
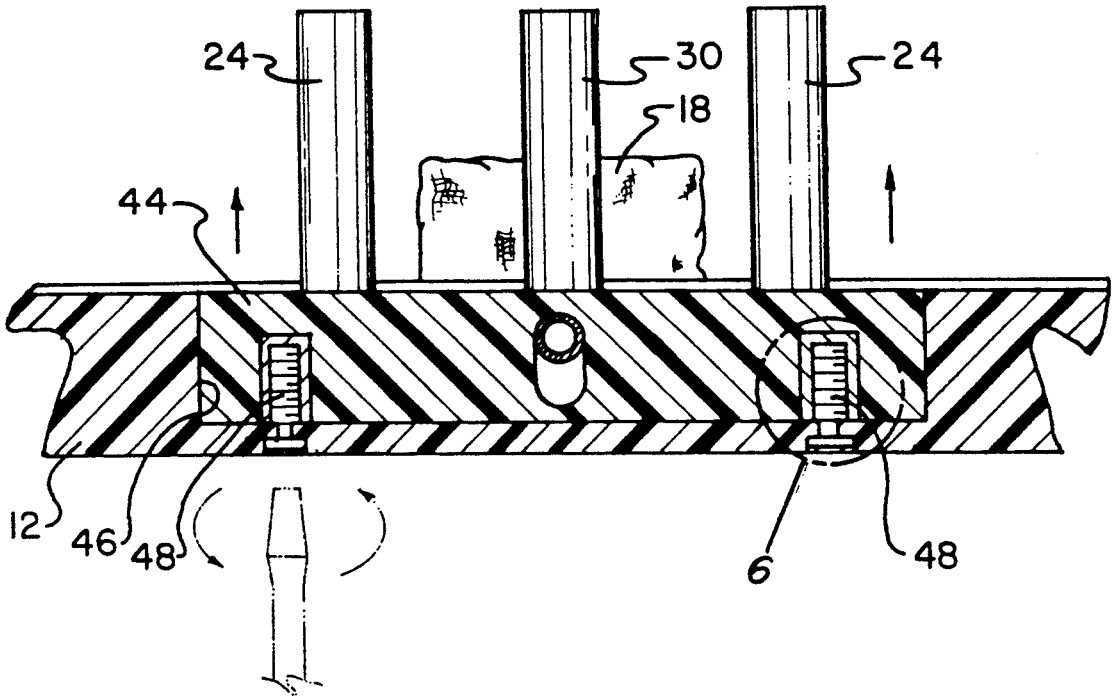
FIG. 5 is a cross-sectional view of a second embodiment of the head support apparatus of the invention which has adjustable features.
Figure 6:
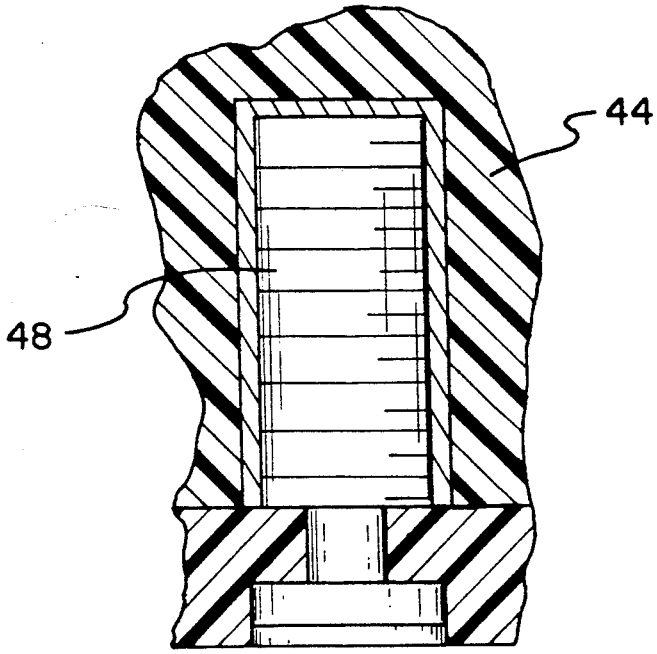
FIG. 6 is an enlarged region of the embodiment of the invention shown in FIG. 5 that is contained in the circled region 6 of FIG. 5.

Turning to FIGS. 5–6, a second embodiment of the head support apparatus 10 of the invention is shown. Reference numerals are shown that correspond to like reference numerals that designate like elements shown in the other figures. In addition, in FIGS. 5–6, an adjusting assembly is provided for adjusting the third horizontal distance 32. The adjusting assembly includes a slidable carriage 44 which supports the peripheral guide members 24 and 30. A groove 46 in the base member 12 supports the slidable carriage 44. Adjustment screws 48 are provided for locking the slidable carriage 44 in a selected position with respect to groove 46.

Figure 7:
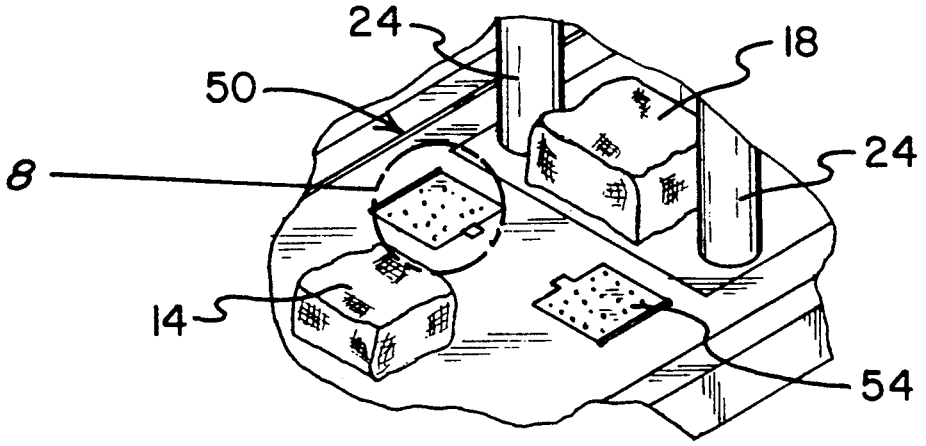
FIG. 7 is a partial perspective view of a third embodiment of the head support apparatus of the invention which includes an aroma diffuser.
Figure 8:
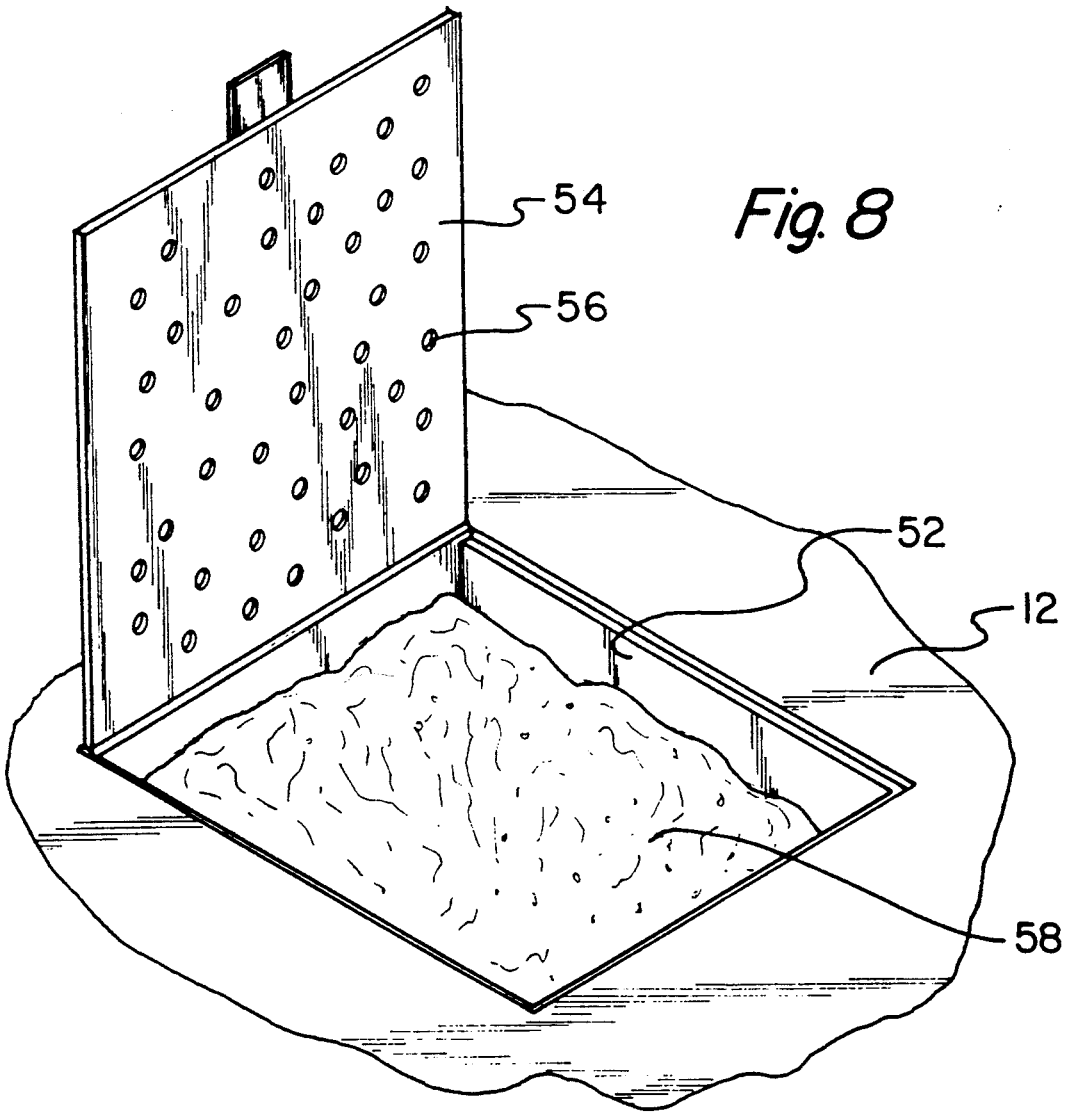
FIG. 8 is an enlarged region of the embodiment of the invention shown in FIG. 7 that is contained in the circled region 8 of FIG. 7.

Turning to FIGS. 7–8, a third embodiment of the head support apparatus 10 of the invention is shown. Reference numerals are shown that correspond to like reference numerals that designate like elements shown in the other figures. In addition, in FIGS. 7–8, an aroma diffuser assembly 50 is provided and is supported by the base member 12. The aroma diffuser assembly 50 includes a well 52 located in the base member 12. A lid 54 includes a plurality of openings 56, and the lid 54 covers the well 52. A quantity of aroma-bearing material 58 is contained in the well 52.

It is apparent from the above that the present invention accomplishes all of the objects set forth by providing a new and improved head support apparatus that is low in cost, relatively simple in design and operation, and which may advantageously be used for supporting a patient's head when the patient is lying in a prone position, such as during surgery or during a medical examination.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved head support apparatus for a person's head, comprising:

a substantially planar base member;

a nonrigid chin rest member supported by said base member and projecting from said base member a first vertical distance which is longer than a nose of the person when a chin of the person is resting on said chin rest member;

a nonrigid forehead rest member supported by said base member and projecting from said member a second vertical distance which is longer than the nose of the person when a forehead of the person is resting on said forehead rest member, and wherein said forehead rest member is spaced from said chin rest member, on said base member by a first horizontal distance which is greater than a height of the nose of the person; and at least two peripheral guide members supported substantially orthogonally by said base member and projecting from said base member a third vertical distance which is longer than said first and second vertical distances and, and wherein said at least two peripheral guide members are spaced from one another on said base member by a second horizontal distance which is sufficient to permit the person's head to be restrained between said peripheral guide members when the forehead of the person is resting on said forehead rest member.

2. The apparatus described in claim 1, further including a third peripheral guide member supported by said base member and projecting from said base member by said third vertical distance which is longer than said first and second vertical distances and, and wherein said third peripheral guide member is spaced from said forehead rest member on said base member by a third horizontal distance which is sufficient to permit a top of the person's head to be restrained by said third peripheral guide member when the forehead of the person is resting on said forehead rest member.

3. The aparatus described in claim 2, further including means for adjusting said third horizontal distance.

4. The apparatus described in claim 3 wherein said adjusting means includes a slidable carriage which supports said at least two peripheral guide members and a groove in said base member which supports said slidable carriage.

5. The apparatus described in claim 4, further including adjustment screws for locking said slidable carriage in a selected position with respect to groove.

6. The apparatus described in claim 1 wherein said base member includes a first air channel for supplying air to said chin rest member and a second air channel for supplying air to said forehead rest member.

7. The apparatus described in claim 3 wherein said first air channel and said second air channel diverge from a common supply tube.

8. The apparatus described in claim 4 wherein said common supply tube includes a one-way valve.

9. The apparatus described in claim 1 wherein said chin rest member and said forehead rest member include microspheres.

10. The apparatus described in claim 6 wherein said microspheres are made from glass.

11. The apparatus described in claim 1, further including:

an aroma diffuser assembly supported by said base member.

12. The apparatus described in claim 11 wherein said aroma diffuser assembly includes:

a well located in said base member;

a lid which includes a plurality of openings, said lid covering said well; and a quantity of aroma-bearing material contained in said well.

* * * * *